United States Patent [19]

Andersen

[11] Patent Number: 4,594,867

[45] Date of Patent: Jun. 17, 1986

[54] SHEET BENDING MACHINE

[75] Inventor: Jørgen S. Andersen, Uldum, Denmark

[73] Assignee: Maskinfabriken Cidan A/S, Uldum, Denmark

[21] Appl. No.: 533,441

[22] Filed: Sep. 19, 1983

[30] Foreign Application Priority Data

Oct. 11, 1982 [DK] Denmark ..... 4483/82

[51] Int. Cl.[4] ..... B21D 5/04

[52] U.S. Cl. ..... 72/7; 72/30; 72/319

[58] Field of Search ..... 72/7, 30, 319–323, 72/157, 316, 293

[56] References Cited

U.S. PATENT DOCUMENTS

| | | | |
|---|---|---|---|
| 348,423 | 8/1886 | Shackleton | 72/321 |
| 2,394,193 | 2/1946 | McCabe | 72/321 |
| 2,699,812 | 1/1955 | McCormack et al. | 72/320 |
| 3,299,681 | 1/1967 | Hautau | 72/7 |
| 3,717,016 | 2/1973 | Peddinghaus | 72/7 |
| 3,726,120 | 4/1973 | Hugert | 72/319 |
| 4,283,929 | 8/1981 | Heiberger | 72/7 |

FOREIGN PATENT DOCUMENTS

| | | | |
|---|---|---|---|
| 1076608 | 3/1960 | Fed. Rep. of Germany | 72/319 |

*Primary Examiner*—Daniel C. Crane

*Attorney, Agent, or Firm*—Birch, Stewart, Kolasch & Birch

[57] ABSTRACT

A sheet bending machine wherein a sheet of metal is fixed between a clamping beam and a lower beam mounted with interchangeable folding rails and wherein the bending is performed by a bending beam being swung against the projecting part of the sheet metal. The interchangeable folding rails have markings, for example, protrusions or recesses on the rear edge which cooperate with a set of members for establishment of a steering code which determines the maximum permissible bending angle for the folding rail. The code may be in the nature of a series of contacts which are opened or closed, dependent on the folding rail being used, having a recess opposite them or not. The state of the contacts may, for example, be sensed by a cam disc which curves synchronically with the swing movement of the bending beam and successively opens the contacts which are connected in parallel above them, so that a current circuit is switched when both corresponding pair of contacts are opened.

5 Claims, 5 Drawing Figures

SHEET BENDING MACHINE

BACKGROUND OF THE INVENTION

1. Field of the Invention

The invention relates to a sheet bending machine of the type wherein the bending of a sheet of metal is performed by swinging a bending beam against a projecting part of the sheet metal fixed between a lower beam and a clamping beam. Such a sheet bending machine is e.g. described in DE-AS No. 1 076 608. The bending beam can be driven by electromotors or it can be moved hydraulically.

2. Description of Background Art

To be able to make various bendings, the clamping beam is usually provided with interchangeable folding rails with profiles permitting sharp bendings of e.g. 135° or profiles permitting a rounded bending of up to 180° which means that the bending beam also must be able to be swung or curved 180°.

To be able to adjust the bending angle in accordance with a certain working plan, the sheet bending machines are usually provided with members which can be programmed to switch off the current to the driving motors or to stop the supply of liquid to the hydraulic punch operating the bending beam. These members can as proposed in the above mentioned publication consist of discs or rolls with manually adjustable protrusion of cams which co-operate with contact rails so that being moved a length by the bending beam corresponding to a desired angle they actuate an electrical switch. For every working operation said discs or rolls are turned a step, so that the new protrusion activates the switching off of the movement of the bending beam. The angle movement of the bending beam can naturally also be operated electronically. Electronical operation on angle movements after an input program is well known and is not going to be described more closely.

Whether the input of the bending machine is performed in one way or another, it may be necessary to switch the program operation off. If after having switched off the automatical operation, the machine is unintentionally adjusted to a bending curve which is greater than the folding rail permits, it can result in damage to the machine. The same thing may take place if the input program and the folding rail used do not correspond. The object of the invention is to indicate such operating members for a sheet bending machine that is secured against fault programming as well as fault operation, so that curving of the bending beam beyond the angle a given folding rail permits is not possible.

SUMMARY OF THE INVENTION

According to the invention each folding rail is provided with markings which co-operate with a set of members fixedly connected with the clamping beam for establishment of a code which determines the maximum curving angle of the bending beam.

The invention can be realized in several ways. The markings can be protrusions on the rear edge of the folding rail or a recess therein. The protrusions or recesses actuate one or more of a series of breakers fixed to the clamping beam. A part of the rear edge of the folding rail may be formed as a leit actuating operating levers for a system of hydraulic valves, or in the folding rail a plate of insulation material may be embedded carrying contact pieces which co-operate with corresponding contact pieces in the clamping beam. The code may be a single selection of a single core, electric and hydraulic, or it may be a selection of a combination of cores. The number of codes must naturally correspond with the number of various folding rails.

If there are only two types of rails, opening and closing of a single circuit will be sufficient to determine the permitted maximum bending angle for each of them. With three circuits e.g. eight angles may be determined. Binary codes will first and foremost be important if the sheet bending machine is operated electronically. By applying voltage to a combination of canals leading to the electronic steering equiment, this can convert the voltage combination to a steering order hindering the exceeding of a certain bending angle though the incoded program is providing a steering order hereto.

The greatest security against fault operation is obtained by using a closed circuit, which independent of the automatic and/or manual steering, switches off the supply of energy to the power of the bending machine, and in this closed circuit a number of switches are inserted and connected in series which separately or in succession are opened by a member being moved synchronously with the bending beam. The switches separately, except for the last in the series, are shunted with one or more switches co-operating with the marking on one or more of the rails. The no-signal current in the closed circuit will be switched off when the bending beam is curved in such an angle that the member opening the switches arrives at the contact where the shunted contact is opened by the marking on the folding rail at the moment fixed on the clamping beam.

BRIEF DESCRIPTION OF THE DRAWINGS

In the following the invention will now be described in detail with reference to the accompanying drawing, in which.

DETAILED DESCRIPTION OF THE INVENTION

Figure 1:
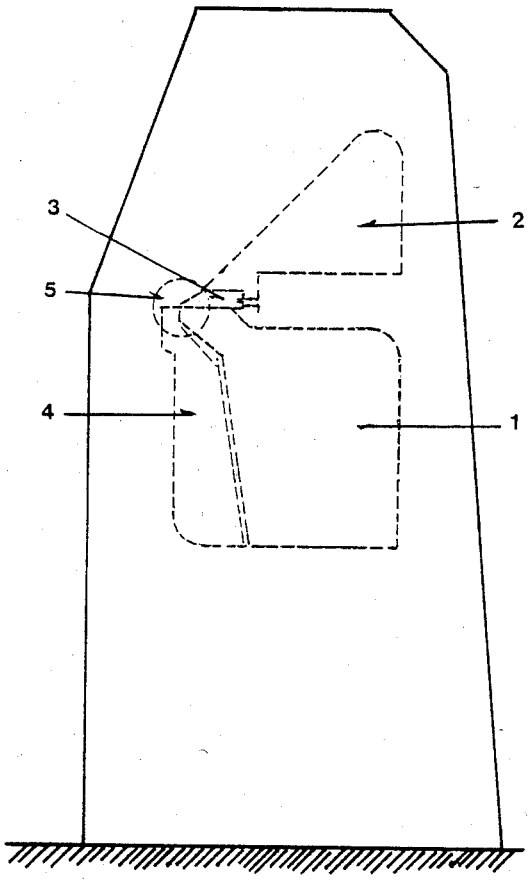
FIG. 1 shows the main parts of a sheet bending machine.

In FIG. 1 the outlines of the parts of a bending machine are shown as stippled, which are necessary for the understanding of the invention, such as they look seen from one end side of the machine. A lower beam 1 is fixed to the machine frame, 2 indicates a clamping beam which manually or automatically e.g. hydraulically can be moved up and down in order to make space for insertion of the sheet metal and fixing the same during the working operation.

The clamping beam has an interchangeable folding rail 3. The construction of the folding rail is essential for the invention and will therefore be described more closely in connection with FIGS. 3 and 4 in the drawing showing a part of the clamping beam and the folding rail in an enlarged scale. A bending beam 4 is provided which can be swung or curved around an axis indicated by the center of the circle 5 in FIG. 1. The bending beam can be worked electrically or hydraulically. The driving mechanism is not comprised by the invention and will therefore not be described here. A drive mechanism is disclosed in the German publication No. 1 076 608 mentioned above dealing with a hydraulically driven sheet bending machine. It is obvious that the rack-and-pinion shown in this publication can be replaced by for example a worm drive which is driven by an electromotor.

Figure 3:
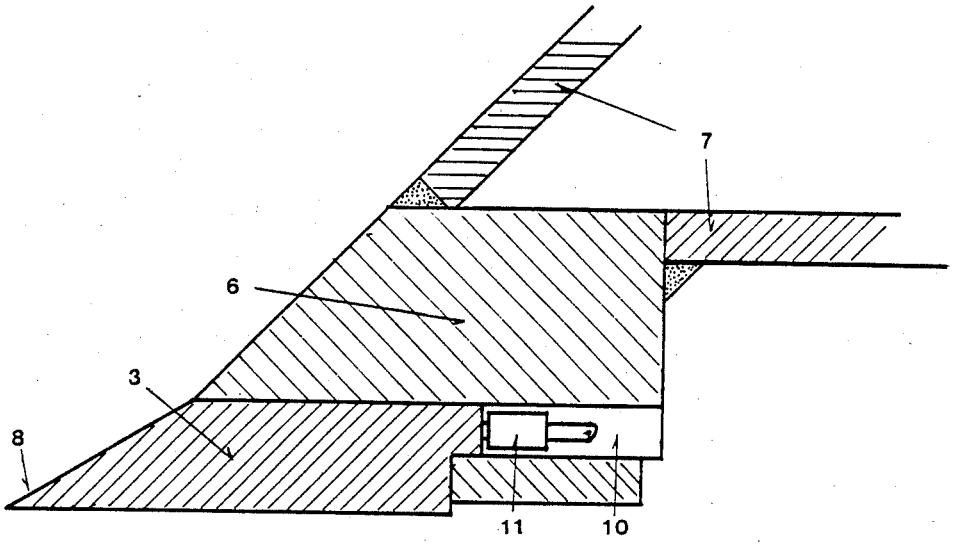
FIG. 3 shows an embodiment of a clamping beam with a folding rail according to the invention.
Figure 4:
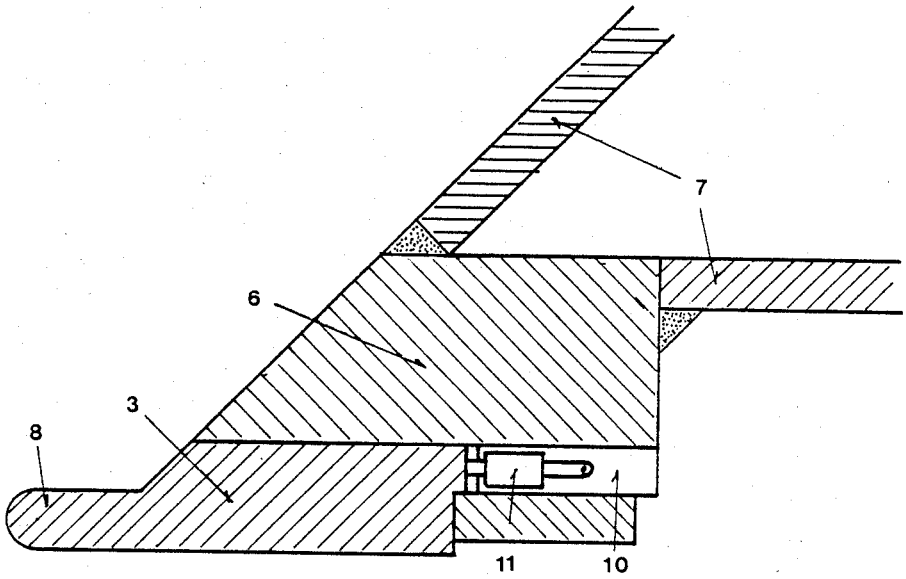
FIG. 4 shows the same clamping beam as shown in FIG. 3 provided with another folding rail.

In FIGS. 3 and 4 a cross section of the clamping beam 2 in FIG. 1 is shown in an enlarged scale, so that the essential construction details for the invention can be seen clearly. The clamping beam comprises as can be seen a rigid front edge beam welded to a frame 7 of sheet iron. The front edge beam carries the folding rail 3 which in FIG. 3 is shown with a nose 8 of about 45°, and which thererfore permits a maximum bending of the edge of the sheet metal of 135°, in practice the bending angle is smaller. The folding rail in FIG. 4 is shown with a round nose 9 permitting a bending of a whole 180°.

As illustrated in FIG. 3, in a space 10 under the beam a number of switches 11 are disposed, so that the rear edge of the rail 3 will actuate a switch. As illustrated in FIG. 4, a recess in the rear edge will actuate a switch. The number of switches is determined by the number of types of rails as it shall be explained in connection with FIGS. 2 and 4.

Figure 2:
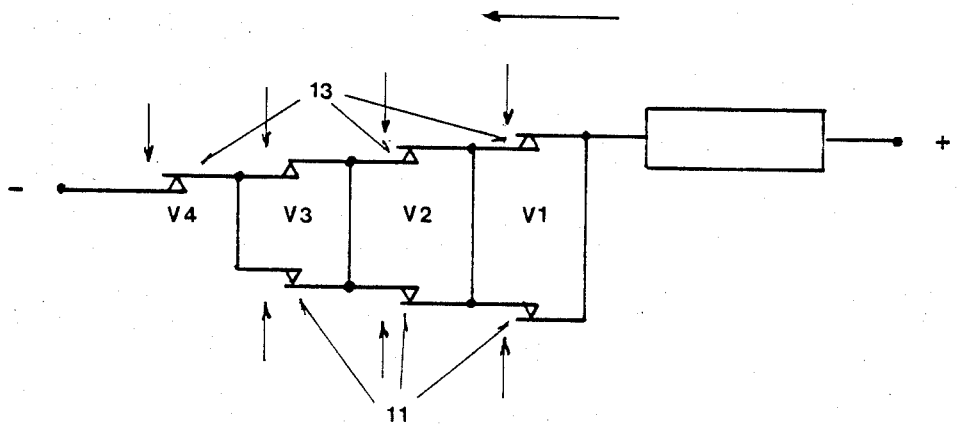
FIG. 2 shows a flow sheet for a control circuit for a sheet bending machine according to the invention.

FIG. 2 is a flow sheet for a current circuit which can be used in connection with a bending machine constructed according to the invention.

In a closed circuit for a control member, which in a simple form may be an electromagnetical switch or a magnetic valve, a number of switches 13 connected in series are inserted which under the normal state are closed, so that a current runs throught the control member. Each of the switches 13 except the last one in the series are shunted with the contacts in the switches 11 which are shown in FIGS. 3 and 4. These switches are closed except the one, for which the used folding rail 3 has a recess. A member which moves synchronically with the bending beam 4 during its curving movement and switches on the first contact in the direction of the horizontal arrow when the bending beam has curved a predeterminded angle $V_1$, and then the next when the bending beam has curved another $V_2$ and so on will not switch off the current unless the shunted contact 11 is switched off too, or when it has reached the last contact in the series.

This current diagram gives, as it is a closed circuit, a greater security of the fact that the maximum bending angle, which is determined by the marking of the folding rail according to the invention—here a recess in the rear edge of the rail—cannot be exceeded by any operation resulting in a damaging to the machine.

Figure 5:
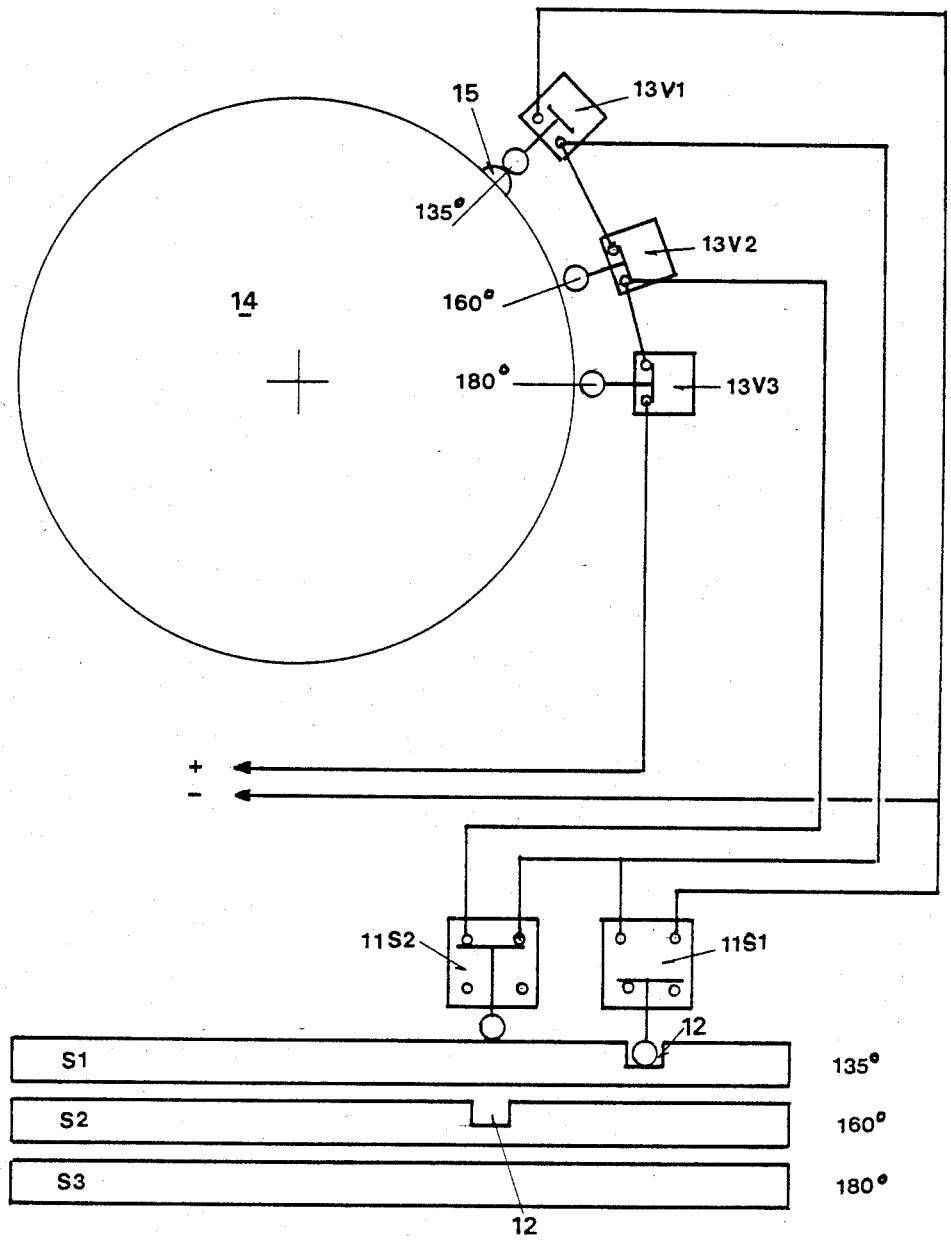
FIG. 5 shows a practical embodiment of the flow sheet as shown in FIG. 2.

FIG. 5 shows a practical embodiment of the flow sheet, as shown in FIG. 2, $S_1$, $S_2$ and $S_3$ indicate three types of rail which respectively permit the bending angles of 135°, 160° and 180°. A cam disc 14 is connected to the shaft of the bending beam and has a single cam 15 which successively actuates three switches 13V1, 13V2 and 13V3 disposed in a circuit around the disc 14, so that the cam 15 actuates 13V1 when the disc has curved 135°, 13V2 when the disc has curved 160° and 13V3 when it has curved 180°.

The switches 11S1 and 11S2 are connected via 13V1 and 13V2 respectively. As it will be seen 11S1 is switched off if a folding rail of the type S2 is in the machine. As it is seen the current is switched off from + to − by curving of the disc 14 of 135°. This angle is passed without interruption of the current if S2 is in the machine, because 11S1 is not interrupted now, but 160° cannot be passed without interruption of the current as 11S2 is open. If the rail S3 is in the machine, both 11S1 and 11S2 are closed and the current is interrupted only by a curving angle of 180° of the disc 14.

The embodiment of the invention described is simple and efficient, but as mentioned above there is nothing to prevent from using the invention in connection with sheet bending machines, where the desired bending angle is determined automatically by an electronic steering system by means of input codes. If so a bit in a binary code system may be represented by the presence or the absence of a recess on a certain place of the folding rail or by a pattern of insulated or conducting areas. The folding rails may also be a part of an in itself well known code converter by giving a part of their rear edge a key profile which by inserting of the rail in the bending machine adjust a number of slideable bars disposed in the clamping beam, and which is their sliding in a well known manner permit one of a number of traversing bars to be slided.

I claim:

1. A sheet bending machine for bending a sheet of material comprising:

a lower beam for supporting a sheet of material;

a clamping beam operatively positioned adjacent to said lower beam for clamping said sheet of material onto said lower beam;

an interchangeable folding rail being operatively affixed to said clamping beam defining a predetermined shape;

a bending beam movably mounted relative to said lower beam, clamping beam and said interchangeable folding rail for imparting movement to a sheet of material clamped between said lower beam and said clamping beam for bending said sheet of material over the interchangeable folding rail;

drive means for imparting movement to said bending beam; and control means for controlling the extent of movement imparted by the drive means to the bending beam;

said control means includes a steering circuit operatively connected to said bending beam and said interchangeable folding rail and switch means actuated by the movement of said bending beam and a selection of an interchangeable folding rail, said selected folding rail having means thereon for coding said steering circuit and establishing the extent of movement of said bending beam imparted by said drive means wherein a selected interchangeable folding rail will limit the extent of movement imparted by said drive means to said bending beam to correspond to a required movement for bending a sheet of material over the predetermined shape of said interchangeable folding rail for preventing damage to said sheet bending machine.

2. A sheet bending machine according to claim 1, wherein the steering circuit is a closed circuit stopping the movement of the bending beam if a no-signal current is switched off, said closed circuit includes a number of switches connected in series which are separately or successively opened by a member moved synchronically with the bending beam, said switches are shunted by operation of the interchangeable folding rail.

3. A sheet bending machine according to claim 2, wherein the member opening the switches connected in series is a cam disc fixed directly to a shaft of the bending beam, and wherein the switches connected in series are disposed with an interval around the cam disc corresponding with the maximum curving angles being permitted in connection with the various predetermined shapes of said interchangeable folding rail.

4. A sheet bending machine for bending a sheet of material comprising:

a lower beam for supporting a sheet of material a clamping beam operatively positioned adjacent to said lower beam for clamping said sheet of material onto said lower beam;

an interchangeable folding rail being operatively affixed to said clamping beam defining a predetermined shape;

a bending beam movably mounted relative to said lower beam, clamping beam and said interchangebale folding rail for imparting movement to a sheet of material clamped between said lower beam and said clamping beam for bending said sheet of material over said interchangeable folding rail;

drive means for imparting movement to said bending beam; and control means for controlling the exent of movement imparted by the drive means to said bending beam;

said control means includes a steering circuit operatively connected to said bending beam and said interchangeable folding rail and switch means actuated by the movement of said bending beam and a selection of an interchangeable folding rail, said selected folding rail having means thereon for coding said steering circuit and establishing the extent of movement of said bending beam imparted by said drive means, wherein a selected interchangeable folding rail will limit the extent of movement imparted by said drive means to said bending beam to correspond to a required movement for bending a sheet of material over the predetermined shape of said interchangeable folding rail for preventing damage to said sheet bending machine, and wherein said means on said folding rail includes protrusions shaped to cooperate with said steering circuit and said clamping beam includes a set of electrical switches which are actuated by said protrusions on said folding rail for controlling said drive means.

5. A sheet bending machine for bending a sheet of material comprising:

a lower beam for supporting a sheet of material;

a clamping beam operatively positioned adjacent to said lower beam for clamping said sheet of material onto said lower beam;

an interchangeable folding rail being operatively affixed to said clamping beam defining a predetermined shape;

a bending beam movably mounted relative to said lower beam, clamping beam and said interchangeable folding rail for imparting movement to a sheet of material clamped between said lower beam and said clamping beam for bending said sheet of material over said interchangeable folding rail;

drive means for imparting movement to said bending beam; and control means for controlling the extent of movement imparted by the drive means to said bending beam;

said control means includes a steering circuit operatively connected to said bending beam and said interchangeable folding rail and switch means actuated by the movement of said bending beam and a selection of an interchangeable folding rail, said selected folding rail having means thereon for coding said steering circuit and establishing the extent of movement of said bending beam imparted by said drive means, wherein a selected interchangeable folding rail will limit the extent of movement imparted by said drive means to said bending beam to correspond to a required movement for bending a sheet of material over the predetermined shape of said interchangeable folding rail for preventing damage to said sheet bending machine, and wherein said means on said folding rail includes recesses shaped to cooperate with said steering circuit and said clamping beam includes a set of electrical switches which are actuated by said protrusions on said folding rail for controlling said drive means.

* * * * *